United States Patent [19]

Nussbaumer

[11] 4,368,924

[45] Jan. 18, 1983

[54] DRIVING SHIELD

[75] Inventor: Manfred Nussbaumer, Leonberg-Ezach, Fed. Rep. of Germany

[73] Assignee: Ed. Züblin Aktiengesellschaft, Stuttgart, Fed. Rep. of Germany

[21] Appl. No.: 256,813

[22] Filed: Apr. 23, 1981

[30] Foreign Application Priority Data

Apr. 23, 1980 [DE] Fed. Rep. of Germany ..... 3015580

[51] Int. Cl.[3] ..... E21D 9/08

[52] U.S. Cl. ..... 299/33; 405/144; 299/11; 299/30

[58] Field of Search ..... 299/11, 33, 81; 405/144

[56] References Cited

U.S. PATENT DOCUMENTS 3,830,545 8/1974 Sugden ..... 299/33

4,314,730 2/1982 Plumpton et al. ..... 299/81 X

FOREIGN PATENT DOCUMENTS 2514125 10/1976 Fed. Rep. of Germany ..... 299/11

*Primary Examiner*—Ernest R. Purser

*Attorney, Agent, or Firm*—Becker & Becker, Inc.

[57] ABSTRACT

A driving shield having a shield shell and a transverse wall for defining a work chamber, and a removal arm pivotally journalled on the transverse wall. The removal arm has a removal tool for mining or removing a face wall which also delimits the work chamber. A pressure medium supply is provided for attaining a support pressure in the work chamber. Material worked away from the face wall is removed by a discharge conduit arranged essentially along the bottom of the shield shell. The work or material-removing arm is journalled on the transverse wall in the pneumatic pressure duct, and the pressure medium supply is embodied as a pneumatic conduit. A sealing medium application device is movably coupled with the work arm, and the delivery nozzle of the device is directed upon the immediate surroundings at the free end of the removal tool.

12 Claims, 1 Drawing Figure

DRIVING SHIELD

Figure 1:
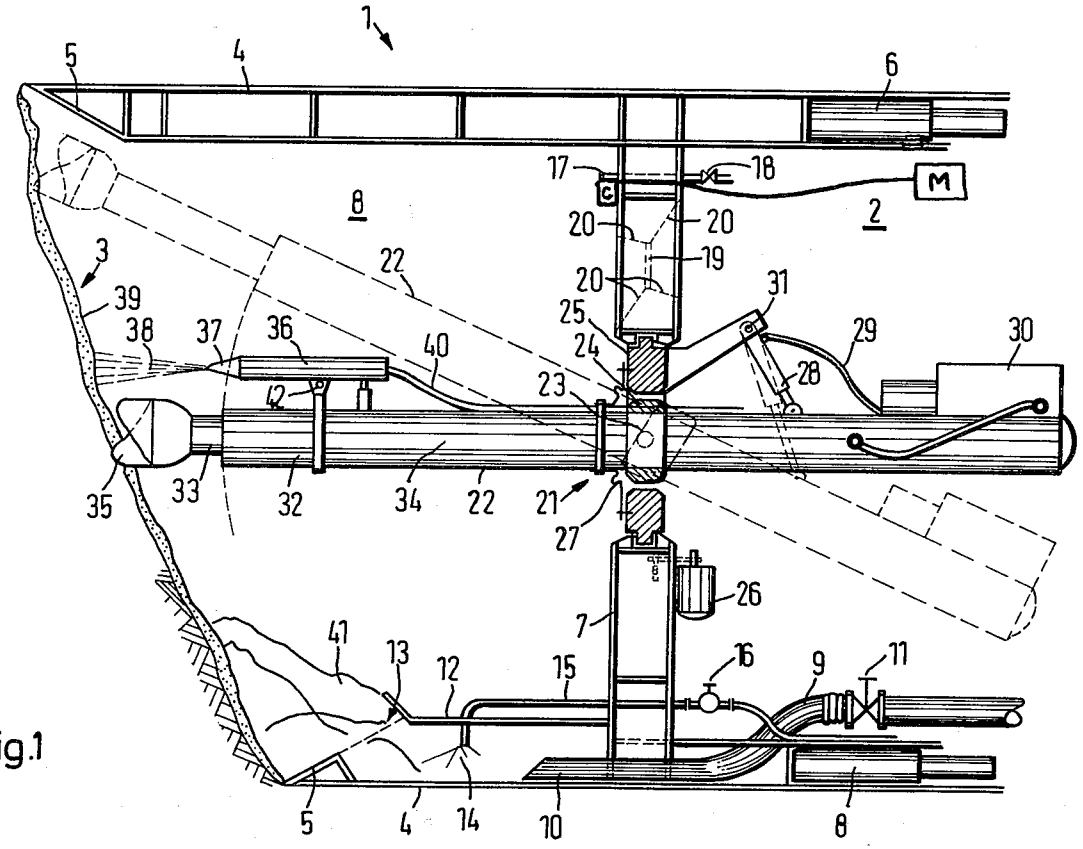

The present invention relates to a driving shield having a shield shell and a transverse wall for defining a work chamber, and a work or removal arm pivotally journalled on the transverse wall. The removal arm has a cutting or removal tool for working or removing a work face or face wall which also delimits the work chamber. A pressure medium supply is provided for attaining a support pressure in the work chamber. Also provided is a discharge conduit, arranged essentially along the bottom of the shield shell, for discharge of the removed material worked away from the face wall.

With a known driving shield of this type (German Pat. No. 24 31 512), a fluid or liquid is introduced by way of the pressure medium supply into the work chamber. This fluid, at an overpressure, fills the work chamber and accordingly is also effective against the face wall. The material removed from the wall by the removal tool is withdrawn through discharge conduits with the aid of the fluid in the work chamber. In this connection, it is disadvantageous that while carrying out the work, the entire work chamber is completely non-transparent because of the contaminated support fluid or liquid, so that an observation of the face wall is not possible during the mining or removal work, and the driving or advancing accordingly occurs practically blind. A further disadvantage consists in that the work chamber, with its complicated pivot mechanism, is always exposed to the surrounding support fluid, which is practically corrosive because of its contamination, whereby particularly the movably guided parts are subjected to an increased frictional loading, and hence are also subject to premature failure.

It is therefore an object of the present invention to improve a driving shield of the initially described type in such a way that a fluid-free transparent medium support is attained in a removal arm environment protective against wear, and that a good sealing of the face wall is attained with seal renewal which directly follows the removal tool.

This object, and other objects and advantages of the present invention, will appear move clearly from the following specification in connection with the accompanying drawing, which schematically illustrates a preferred embodiment of the present invention.

The driving shield of the present invention is characterized primarily in that the removal arm is journalled on the transverse wall in a pneumatic pressure duct or lead-in means, in that the pressure medium supply is embodied as a pneumatic conduit, and in that a sealing medium application device is movably coupled with the removal arm, the application nozzle of the sealing medium application device being directed upon the immediate surroundings at the free end of the removal tool.

An advantage attained with the present invention is that the driving or advancing work at the face wall can be continuously accurately observed since no contaminated support fluid or liquid is present in the work chamber; rather, the support pressure in the work chamber is maintained exclusively by compressed air which is introduced into the work chamber through the pneumatic conduit. By means of the thus possible visual working, the mining of the face wall can be carried out very precisely, since an operator or observer can react immediately upon spotting obstacles such as rocks, boulders, or the like so that damage to the removal tools or other devices can be avoided, whereby repair work is extensively eliminated and a savings in replacement part costs and wages is attained. The removal of the face wall is effected while taking into consideration the existing geology entirely individually in conformity with the respectively existing ground conditions, whereby already one person can readily observe and control the removal. In this way, the ground conditions can be continuously examined and controlled, so that also immediately conclusions can be drawn concerning further enlargement, extension, or completion of the tunnel.

A further advantage of the present invention teaching consists in that, for example with possible maintenance work or a replacement of the removal or mining tool, the entire support fluid or liquid need not be entirely removed from the work chamber, as was necessary previously, which is costly in work and time. Rather, with the present inventive teaching, after opening an air lock or the like, the necessary work can be readily carried out at the specific location without having to reduce or even completely remove the support pressure. Additionally, there is attained the advantage that the degree of wear of the removal tools, as for example the wear on the cutting teeth of the removal tool, can be accurately observed, so that at the correct time, the removal tool can be replaced. Also, upon striking a boulder with the known apparatus, the supporting fluid or liquid must be drained completely so that an operator can go into the work chamber in order at that location to manually eliminate the obstacle. In contrast, with the present inventive driving shield, a boulder can be immediately removed by the operator without support pressure reduction, whereby additionally with the aid of the visibly controlled removal or working arm, any boulder encountered in the face wall can be removed precisely without the removal tool being damaged thereby.

Additionally, with the present invention there is attained the advantage that the face wall, except for a small working region, is nearly completely sealed by a membrane-like sealing medium layer. Consequently, support medium losses are extensively reduced, and a high support pressure constancy or stability is attained, so that only extremely nominal subsequent supplying is required to be introduced through the pneumatic conduit. Since the sealing medium application device is positively or automatically controlled with the removal arm, and the discharge nozzle applies the sealing medium closely adjacent to the removal tool during removal of the face wall, during further advancement of the removal arm the just worked location of the face wall is immediately tightly closed again. Since with the inventive driving shield, the utilization of a very expensive support fluid or liquid is eliminated, no liquid or fluid influences enhanced by dirt deposits are any longer encountered on the removal arm structure, so that a long and service-free operation is provided. The material worked or mined away with the inventive apparatus is discharged outwardly from the work chamber by way of the discharge conduit arranged near the bottom of the shield shell. Additionally, the inventive pneumatic pressure procedure likewise contributes to high support pressure constancy or stability in the work chamber, so that also in this region of the transverse wall, in which the work arm is brought outwardly, no compressed air can escape.

According to specific features of the present invention, the sealing medium discharge or application device may be arranged on a cylinder tube of the removal arm. The sealing medium application device may be fastened on the removal arm and be pivotable in all directions as required. The removal tool may be arranged on a piston rod extensibly journalled in the cylinder tube.

The sealing medium discharge device may have a supply conduit which passes through the pneumatic pressure duct in the region of the removal arm. The removal arm may be journalled in a turntable in the region of the pneumatic pressure duct. The removal arm may be pivotable about a pivot pin on a guide part mounted in the turntable. The pneumatic pressure passage duct, on the removal arm, may have a sealing sleeve in the region of the turntable and the guide part. A mounting bracket of a lifting element capable of pivoting the work arm may be arranged on the turntable.

A support pressure control valve may be associated with the pneumatic conduit. A viewing plate may be arranged in the transverse wall above the pneumatic pressure duct. A monitor may be provided for observation, and may include a camera directed into the work chamber and associated with the transverse wall or the shield shell.

By utilizing these preferred embodiments and further improvements of the present invention in an advantageous manner, an expedient sealing medium application as well as advantageous mounting and movement possibilities on the work arm can be attained, and advantageous observation features for the face wall removal as well as extensively dust-free discharge of the removed material are attained.

Referring now to the drawing in detail, the illustrated driving shield 1 is located in a gallery, shaft or tunnel 2 which is driven or pushed ahead by removal or mining of a work face or face wall 3. The driving shield 1 has a shield shell 4 which is provided with shield cutters 5 facing the wall 3. The driving shield 1 is shiftable or displaceable by way of driving presses 6 which engage the shield shell 4. A transverse wall 7 is arranged in the shield shell 4 at a distance from the shield cutters 5. A work or removal chamber 8 is thus defined by the transverse wall 7, the shield shell 4, and the wall 3.

A discharge conduit 9 is arranged near the bottom of the shield shell 4. This discharge conduit 9 passes through the transverse wall 7, and a suction end 10 of the conduit 9 projects into the work chamber 8. The discharge conduit 9 is provided with a feed control valve 11.

The suction end 10 of the discharge conduit 9 is located in the region of a feed box 12, which has an opening 13. The feed box 12 has a rinsing device 14 associated therewith which is located before the suction end 10 of the discharge conduit 9 and is supplied by a conduit 15 which passes through the transverse wall 7 and has a valve 16.

At the top, below the shield shell 4, there is arranged a pneumatic conduit 17 which passes through the transverse wall 7 and projects into the work chamber, so that compressed air can be introduced into the work chamber 8. This compressed air is controllable by a support-pressure control valve 18 for building up a constant support pressure in the work chamber 8.

A window shield or viewing plate 19 is arranged in the transverse wall 7 below the pneumatic conduit 17. Through this viewing plate 19, an operator can look from the outside/into the work chamber 8. So that in particular the entire wall 3 can be observed without hindrance, visual inclines 20 are provided on the transverse wall 7 along the peripheral region of the viewing plate 19 in such a way that a larger free space or viewing angle is provided for observation purposes.

A pneumatic pressure passage or duct 21 is arranged directly below the viewing plate 19 approximately in the middle region of the transverse wall 7; a work or removal arm 22 is guided through this duct 21. The removal or mining arm 22 is pivotable about a pivot or king pin 23 which is journalled in a guide part 24. This guide part 24 in turn is journalled in a turntable 25, which externally delimits the pneumatic pressure duct 21, is rotatably journalled in the transverse wall 7, and is capable of being rotated by a drive motor 26. Additionally, a sealing collar or sleeve 27 is arranged on the removal arm 22 in the region of the turntable 25 and the guidance part 24 so that the pneumatic pressure duct 21 in the central region of the transverse wall 7 has a high assurance against compressed air leakage.

The removal arm 22 is pivoted by means of a lifting element 28, which is supplied by a control circuit 29 from a unit 30. One end of the lifting element 28 is pivotally connected to the removal arm 22, and the other end to a mounting bracket 31 which is fastened to the turntable 25.

The removal arm 22 has a cylinder tube 32 in which a piston rod 33 is journalled which is extensible and retractable in the direction of the longitudinal axis 34, and which likewise can be controlled from the unit 30. At the free end of the piston rod 33 is located a removal tool 35 embodied as a cutting head, which works away the material at the wall 3.

A sealing medium delivery or application device 36 is arranged at the free end region of the cylinder tube 32. This sealing medium delivery device 36 is secured in such a way that it can be rotated as required about the longitudinal axis 34 of the removal arm 22, and simultaneously can be tilted about the joint 42. The sealing medium delivery device 36 is embodied as a spray device having delivery nozzles 37 which are directed in such a way that sealing medium 38 sprayed therefrom directly adjacent the free end of the removal tool 35 strikes the wall 3, thus assuring that immediately after further pivoting of the removal arm 22, the mined area of the wall 3 is automatically directly sealed off again, so that a sealing membrane 39, advantageously comprising a fine granular fraction or a bentonite suspension, always covers nearly the entire surface of the wall 3. The sealing medium delivery device 36 is supplied by a supply conduit 40 which extends along the cylinder tube 32 and is guided outwardly through the pneumatic pressure duct 21, so that the conduit 40 here can be supplied externally of the work chamber 8 with the respectively needed sealing medium 38.

It is clearly recognizable from the drawing that with the inventive driving shield it is possible to achieve an exact working under accurate and continuous observation of the working location. The observation of the working location need not absolutely occur directly through the viewing plate 19, but, according to a preferred embodiment, can, for example, also occur in connection with a remote controlled operation by way of a monitor M, whereby a suitable pick-up or surveying camera C is arranged either on the inner side of the transverse wall 7 facing the work chamber 8 or on the shield shell 4, or is installed externally behind the viewing plate 19.

The removed material 41 worked away from the wall 3 with the removal tool 35 passes through the opening 13 into the conveying box 12, where it is wetted or washed by the rinsing device 14, and is subsequently withdrawn outwardly through the suction end 10 of the discharge conduit 9. In this way, it is possible to again separate the fine components of the removed material 41 and to mix them with the sealing medium 38 for renewal of the sealing membrane 39.

The present invention is, of course, in no way restricted to the specific disclosure of the specification and drawing, but also encompasses any modifications within the scope of the appended claims.

What I claim is:

1. A driving shield for use in working or mining a face wall of a gallery, said driving shield comprising:

a shield shell;

a transverse wall arranged in said shield shell, said face wall, said shield shell, and said transverse wall delimiting a work chamber, said transverse wall being provided with a pneumatic pressure duct;

a removal arm pivotably journalled on said transverse arm in said pressure duct;

a removal tool provided on said removal arm for removing material from said face wall;

a discharge conduit arranged in the bottom of said shield shell for the discharge from said work chamber of material removed from said face wall;

a pneumatic conduit which passes through said transverse wall into said work chamber for producing a support pressure therein;

a device for applying sealing medium, said device being movably coupled with said removal arm; and an application nozzle operatively associated with said application device for receiving sealing medium therefrom and effecting application thereof onto said face wall in the immediate vicinity of said removal tool.

2. A driving shield according to claim 1, in which said removal arm includes a cylinder tube, said sealing medium application device being arranged on said cylinder tube.

3. A driving shield according to claim 2, in which said application device is mounted on said removal arm in such a way as to be pivotable in all directions.

4. A driving shield according to claim 3, which includes a piston rod extensibly and retractably arranged in said cylinder tube of said removal arm, said removal tool being mounted to said piston rod.

5. A driving shield according to claim 4, which includes a source of sealing medium arranged externally of said work chamber, and a supply conduit passing from said source through said pressure duct to said application device.

6. A driving shield according to claim 5, which includes a turntable mounted in said transverse wall in the region of said pressure duct thereof, said removal arm being journalled in said turntable.

7. A driving shield according to claim 6, in which said turntable includes a guide part provided with a pivot pin, said removal arm being pivotable about said pivot pin.

8. A driving shield according to claim 7, which includes a sealing sleeve arranged on said removal arm and said turntable in the region of said guide part for closing off said pressure duct.

9. A driving shield according to claim 8, in which said turntable is provided with a mounting bracket, and which includes a lifting element connected to said mounting bracket and to said removal arm for effecting pivoting of said removal arm.

10. A driving shield according to claim 9, in which a support pressure control valve is associated with said pneumatic conduit.

11. A driving shield according to claim 9, which includes a viewing plate arranged in said transverse wall above said pressure duct.

12. A driving shield according to claim 11, which includes a monitor for monitoring said mining, and a camera associated with said monitor and directed into said work chamber.

* * * * *